US012674309B2

(12) United States Patent
O'Connell et al.

(10) Patent No.: US 12,674,309 B2
(45) Date of Patent: Jul. 7, 2026

(54) MODULAR BIDET ATTACHMENT

(71) Applicant: Whisper Bidets Inc., Portland, OR (US)

(72) Inventors: Chad Joseph O'Connell, Portland, OR (US); Mark Alan Kruse, Brooklyn, NY (US)

(73) Assignee: ASSET INC., Portland, OR (US)

( * ) Notice: Subject to any disclaimer, the term of this patent is extended or adjusted under 35 U.S.C. 154(b) by 245 days.

(21) Appl. No.: 18/411,308

(22) Filed: Jan. 12, 2024

(65) Prior Publication Data

US 2024/0240444 A1 Jul. 18, 2024

Related U.S. Application Data

(60) Provisional application No. 63/479,968, filed on Jan. 13, 2023.

(51) Int. Cl.
*E03D 9/08* (2006.01)

(52) U.S. Cl.
CPC ..... *E03D 9/08* (2013.01)

(58) Field of Classification Search
CPC ..... E03D 9/08
USPC ..... 4/420.4, 420, 447, 428
See application file for complete search history.

(56) References Cited

U.S. PATENT DOCUMENTS 4,638,514 A * 1/1987 Landsberger ..... E03D 9/08 4/235
4,926,509 A * 5/1990 Bass ..... E03D 9/08 4/420.4
5,287,566 A * 2/1994 Azada ..... E03D 9/08 239/104
5,504,948 A * 4/1996 Chandler ..... A47K 13/24 4/420.4
5,666,672 A * 9/1997 Birsel ..... E03D 9/08 4/236
5,735,798 A * 4/1998 Shinohara ..... A61B 5/02241 600/490
6,178,568 B1 * 1/2001 Boulieris ..... E03D 9/08 4/420.4

(Continued)

FOREIGN PATENT DOCUMENTS

CA 2485748 A1 * 5/2006 ..... E03D 9/08
CA 3151864 A1 * 9/2022 ..... A61H 35/00

(Continued)

OTHER PUBLICATIONS

"Wayfair Bio Bidet 7Z-W-Essential-Light Bio Bidet Essential Attachment for Toilet Seats, Adjustable Water Pressure, Self Cleaning Nozzles", Retrieval date: Jun. 4, 2025, Retrieved from internet: https://www.wayfair.com/home-improvement/pdp/bio-bidet-essential-attachment-for-toilet-seats-adjustable-water-pressure-self-cleaning-nozzles-xip10014.html, 71 pgs.

(Continued)

*Primary Examiner* — Lori L Baker
(74) *Attorney, Agent, or Firm* — Kwan & Olynick LLP

(57) ABSTRACT

A modular bidet attachment. The modular bidet attachment includes mounting discs that mount to a bidet chassis via a snap fit mechanism. The mounting discs include openings that are less than half the length of the diameter of the mounting discs. The mounting discs are configured to rotate after being mounted to the chassis.

20 Claims, 20 Drawing Sheets

(56) References Cited

U.S. PATENT DOCUMENTS

| | | | | |
|---|---|---|---|---|
| 6,671,892 | B1 * | 1/2004 | Plyant | E03D 9/085 4/445 |
| 7,543,339 | B1 * | 6/2009 | Harris | E03D 1/01 4/445 |
| 9,194,115 | B1 * | 11/2015 | Green | E03D 13/00 |
| 9,594,500 | B2 * | 3/2017 | Clements | G06F 3/017 |
| 10,407,888 | B2 * | 9/2019 | Hall | G06V 40/10 |
| 11,542,699 | B2 * | 1/2023 | Schrant | E03D 9/08 |
| 11,814,834 | B2 * | 11/2023 | Gupta | B05B 15/16 |
| 11,879,244 | B2 * | 1/2024 | Ethier | E03D 9/085 |
| D1,061,833 | S * | 2/2025 | Lin | D23/295 |
| 12,371,888 | B2 * | 7/2025 | Dunigan | E03D 9/005 |
| 12,404,894 | B2 * | 9/2025 | Smith | F16C 11/04 |
| 2004/0055080 | A1 * | 3/2004 | Marshall | E03D 9/08 4/420.4 |
| 2006/0037129 | A1 * | 2/2006 | Bhatnagar | E03D 9/08 4/420.4 |
| 2008/0235861 | A1 * | 10/2008 | Uy | E03D 9/08 4/420.4 |
| 2009/0044324 | A1 * | 2/2009 | Meshreky | A47K 13/302 4/444 |
| 2014/0041745 | A1 * | 2/2014 | Vu | E03D 9/08 285/179 |
| 2014/0101838 | A1 * | 4/2014 | Gupta | B05B 15/16 4/448 |
| 2018/0209129 | A1 * | 7/2018 | He | E03D 9/08 |
| 2019/0368182 | A1 * | 12/2019 | Ethier | E03D 9/085 |
| 2021/0285198 | A1 * | 9/2021 | Halloran | E03D 1/266 |
| 2021/0293013 | A1 * | 9/2021 | Schrant | E03D 9/08 |
| 2021/0310226 | A1 * | 10/2021 | Newcomb | E03D 9/007 |
| 2022/0298771 | A1 * | 9/2022 | Gupta | E03D 9/08 |
| 2025/0092656 | A1 * | 3/2025 | Muraoka | E03D 9/08 |
| 2025/0223788 | A1 * | 7/2025 | O'Connell | E03D 9/08 |

FOREIGN PATENT DOCUMENTS

| | | | | |
|---|---|---|---|---|
| CN | 203088951 U | * | 7/2013 | |
| CN | 203891168 U | * | 10/2014 | |
| CN | 205804536 U | * | 12/2016 | E03D 9/08 |
| CN | 221083514 U | * | 6/2024 | E03D 9/08 |
| GB | 2332456 A | * | 6/1999 | E03D 9/08 |
| GB | 2338249 A | * | 12/1999 | E03D 9/08 |
| JP | 2017197967 A | * | 11/2017 | E03D 11/02 |
| JP | 2018127848 A | * | 8/2018 | E03D 9/08 |
| JP | 2018127849 A | * | 8/2018 | E03D 9/08 |
| JP | 2020079558 A | * | 5/2020 | E03D 9/002 |
| KR | 20240057544 A | * | 5/2024 | G06Q 20/065 |
| KR | 20240057547 A | * | 5/2024 | H04N 7/18 |
| KR | 102823197 B1 | * | 6/2025 | G01L 1/005 |
| WO | WO-9615331 A1 | * | 5/1996 | E03D 9/08 |
| WO | WO-9628620 A1 | * | 9/1996 | E03D 9/08 |
| WO | WO-2017169221 A1 | * | 10/2017 | E03D 9/08 |
| WO | WO-2017169222 A1 | * | 10/2017 | E03D 9/08 |
| WO | WO-2017169223 A1 | * | 10/2017 | E03D 11/02 |
| WO | WO-2017169224 A1 | * | 10/2017 | E03D 11/02 |
| WO | WO-2017169227 A1 | * | 10/2017 | E03D 11/02 |
| WO | WO-2022149002 A1 | * | 7/2022 | E03D 9/08 |
| WO | WO-2022192985 A1 | * | 9/2022 | A61H 35/00 |
| WO | WO-2023068451 A1 | * | 4/2023 | B05B 1/26 |
| WO | WO-2023149600 A1 | * | 8/2023 | E03D 9/08 |
| WO | WO-2023218222 A1 | * | 11/2023 | E03D 9/08 |
| WO | WO-2024249447 A2 | * | 12/2024 | E03D 9/08 |

OTHER PUBLICATIONS

"Wayfair Hibbent EB080-CP Ultra-Slim Adjustable Toilet Seat Bidet, Non-electric Dual Nozzle", Retrieval date: Jun. 4, 2025, Retrieved from internet: https://www.wayfair.com/home-improvement/pdp/hibbent-ultra-slim-adjustable-toilet-seat-bidet-non-electric-dual-nozzle-hbae1014.html, 48 pgs.

"Wayfair Swiss Madison-BSA01 Aqua Non-Electric Bidet Toilet Attachment", Retrieval date: Jun. 4, 2025, Retrieved from internet: https://www.wayfair.com/home-improvement/pdp/swiss-madison-aqua-non-electric-bidet-toilet-attachment-swmd1708.html, 77 pgs.

* cited by examiner

MODULAR BIDET ATTACHMENT

CROSS-REFERENCE TO RELATED APPLICATIONS

This application claims priority to Provisional U.S. Pat. Application No. 63/479,968, titled "MODULAR BIDET ATTACHMENT," filed on Jan. 13, 2023, by Chad Joseph O'Connell et al., which is incorporated herein by reference in its entirety and for all purposes.

TECHNICAL FIELD

The present disclosure relates generally to bathroom fixtures, and more specifically to bidets for toilets.

DESCRIPTION OF RELATED ART

A bidet is a bowl or receptacle designed to be sat on in order to wash one's genitalia, perineum, inner buttocks, and anus. Some bidets have a plumbed-in water supply and a drainage opening. The bidet is designed to promote personal hygiene and is used after defecation, and before and after sexual intercourse. By using a water stream to help clean, a bidet reduces the need to use excessive amounts of toilet paper for cleaning after a bowel movement. If a user has a hemorrhoid or other anal irritation, wiping can aggravate the problem. Rinsing with a bidet is gentle, natural, and soothing. Fixtures that combine a toilet seat with a washing facility include the electronic bidets and manual bidets.

Although bidets provide a lot of benefits, bidets can also have a lot of drawbacks. For example, over time, grime gets stuck in traditional mounting disc openings in the bidets. In addition, properly cleaning a toilet becomes very difficult once a bidet attachment is installed because the bidet is securely fixed in place and prevents easy access to certain areas of the toilet bowl. Another problem is that the water can be accidently turned on by a child or by inadvertently bumping into the water activation knob. Yet another problem for bidets is that the bidet sprayer nozzle hangs a few inches into the bowl at a 90 degree angle. This often interferes with the toilet seat because the toilet bowl edge is often times sloped or rounded. Thus, there is a need for an improved modular bidet attachment that addresses all of the above-mentioned problems.

SUMMARY

The following presents a simplified summary of the disclosure in order to provide a basic understanding of certain embodiments of the present disclosure. This summary is not an extensive overview of the disclosure and it does not identify key/critical elements of the present disclosure or delineate the scope of the present disclosure. Its sole purpose is to present some concepts disclosed herein in a simplified form as a prelude to the more detailed description that is presented later.

One aspect of the present disclosure relates to a bidet attachment. The bidet attachment includes a chassis configured to mount to two mounting discs via a snap fit mechanism. The bidet attachment also includes a sprayer nozzle. The bidet attachment also includes a water valve lever configured to activate and shut off water spraying through the sprayer nozzle.

In some embodiments, each of the mounting discs are configured to rotate after being mounted to the chassis. In some embodiments, each of the mounting discs comprises a single opening in an otherwise solid disc, the opening having a length of just under half of the diameter of the mounting disc, and a width that is less than half of the length. In some embodiments, the sprayer nozzle is attached to the chassis at an angle that is greater than 90 degrees and less than 105 degrees. In some embodiments, the water valve lever is configured to automatically shut off after it has been turned on for some time. In some embodiments, the water valve lever includes two torsion springs to cause it to shut off automatically. In some embodiments, the handle is interchangeable with other handles by using magnets and/or a snap fit feature.

These and other embodiments are described further below with reference to the figures.

BRIEF DESCRIPTION OF THE DRAWINGS

The disclosure may best be understood by reference to the following description taken in conjunction with the accompanying drawings, which illustrate particular embodiments.

DESCRIPTION OF EXAMPLE EMBODIMENTS

Reference will now be made in detail to some specific examples of the present disclosure including the best modes contemplated by the inventors for carrying out the present disclosure. Examples of these specific embodiments are illustrated in the accompanying drawings. While the present disclosure is described in conjunction with these specific embodiments, it will be understood that it is not intended to limit the present disclosure to the described embodiments. On the contrary, it is intended to cover alternatives, modifications, and equivalents as may be included within the spirit and scope of the present disclosure as defined by the appended claims.

For example, portions of the techniques of the present disclosure will be described in the context of manual bidet attachments. However, it should be noted that the techniques of the present disclosure apply to a wide variety of different attachments. In the following description, numerous specific details are set forth in order to provide a thorough understanding of the present disclosure. Particular example embodiments of the present disclosure may be implemented without some or all of these specific details. In other instances, well known process operations have not been described in detail in order not to unnecessarily obscure the present disclosure.

Various techniques and mechanisms of the present disclosure will sometimes be described in singular form for clarity. However, it should be noted that some embodiments include multiple iterations of a technique or multiple instantiations of a mechanism unless noted otherwise. For example, a system uses a handle in a variety of contexts. However, it will be appreciated that a system can use multiple handles while remaining within the scope of the present disclosure unless otherwise noted. Furthermore, the techniques and mechanisms of the present disclosure will sometimes describe a connection between two entities. It should be noted that a connection between two entities does not necessarily mean a direct, unimpeded connection, as a variety of other entities may reside between the two entities. For example, the handle may be connected to the water spray nozzle, but it will be appreciated that a variety of tubes and connectors, may reside between the handle and the water spray nozzle. Consequently, a connection does not necessarily mean a direct, unimpeded connection unless otherwise noted.

Figure 1A:
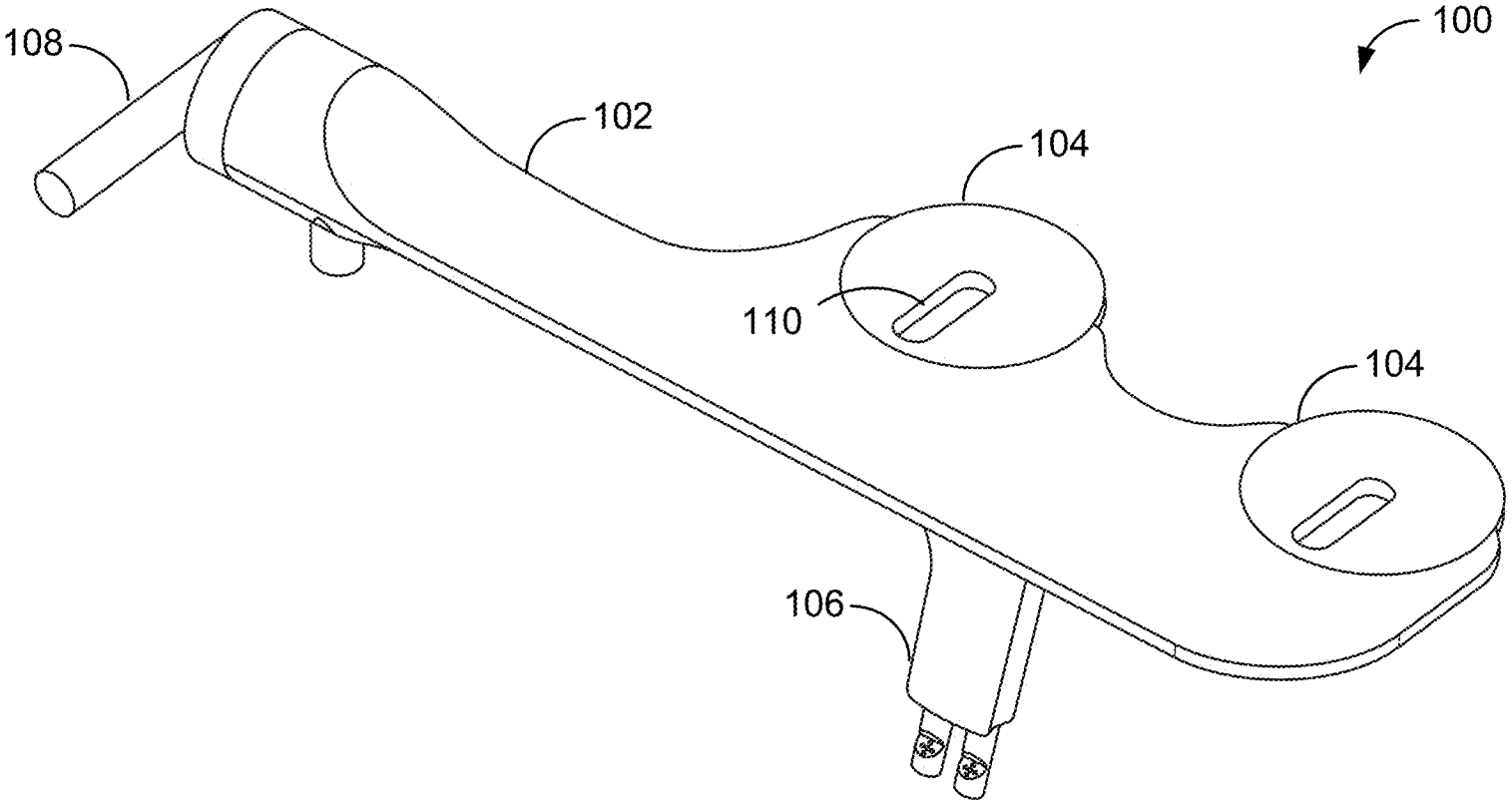
FIG. 1A illustrates an example bidet attachment, in accordance with embodiments of the present disclosure.

FIG. 1A illustrates an example bidet attachment, in accordance with embodiments of the present disclosure. The example bidet attachment 100 includes a chassis 102, mounting discs 104, a sprayer nozzle 106, and a lever handle 108. Mounting discs 104 are for installation of bidet attachment 100 onto a toilet by putting the toilet seat bolts through the slit-like (but much wider than actual slits) openings 110 on mounting discs 104. Lever handle 108 turns the water on and off, and sprayer nozzle 106 delivers water as a spray or stream. Chassis 102 forms the body of the bidet and mounts onto mounting discs 104, once the mounting discs have been installed onto the toilet via the toilet seat bolts. Chassis 102 holds the other features together and houses the different tubes that carry water for different purposes.

Figure 1B:
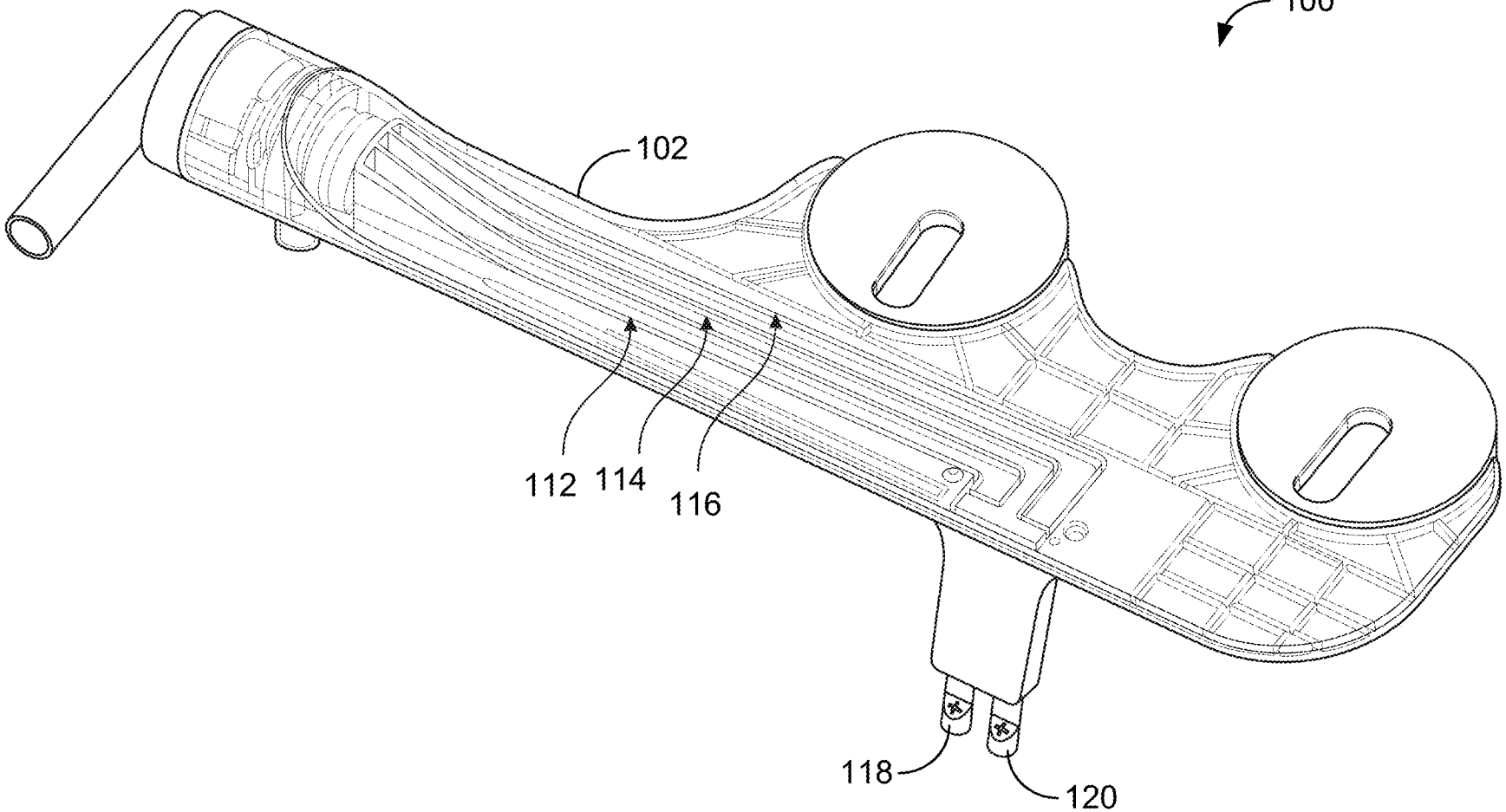
FIG. 1B illustrates a horizontal slice view of an example bidet attachment, in accordance with embodiments of the present disclosure.

FIG. 1B illustrates a horizontal slice view of an example bidet attachment, in accordance with embodiments of the present disclosure. Inside chassis 102 are tubes or ducts that deliver water to different parts of the bidet for different purposes. One duct/tube 112 delivers water to a front wash nozzle 118 to spray the frontal area of a user sitting on the toilet. Another duct/tube 116 delivers water to a rear wash nozzle 120 to spray the rear area of a user sitting on a toilet. A third duct/tube 114 delivers water directly onto the front and rear sprayer nozzles in order to wash and clean the sprayer nozzles. In some embodiments, bidet attachment 100 can include just one of the ducts/tubes described, any two ducts/tubes described, or all three ducts/tubes described.

Figure 1C:
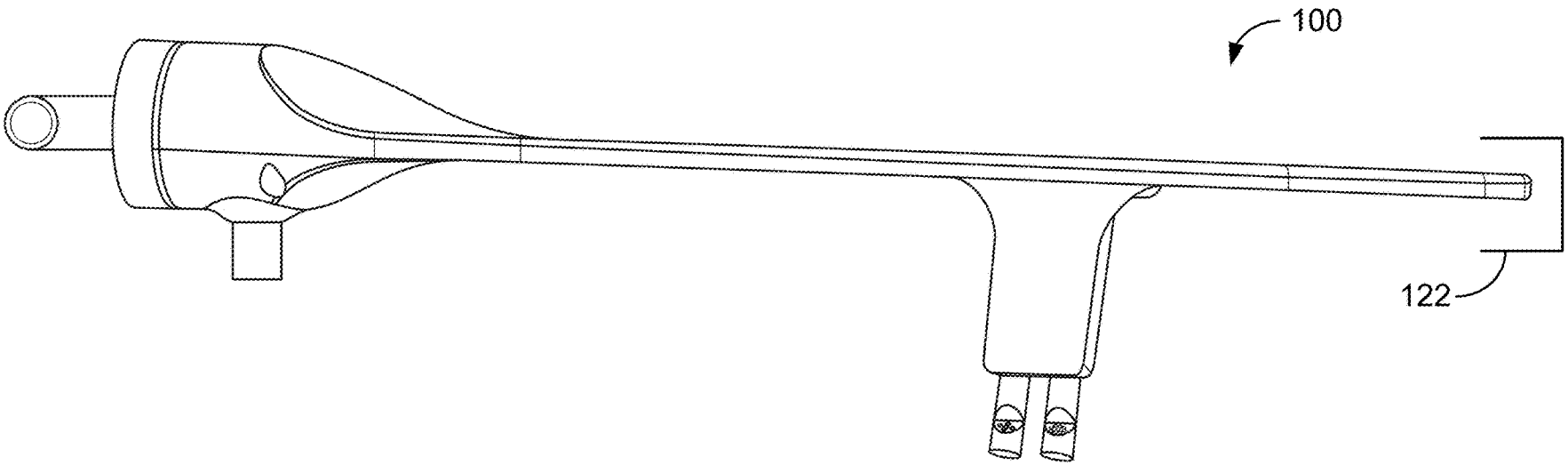
FIG. 1C illustrates a front view of an example bidet attachment, in accordance with embodiments of the present disclosure.

According to various embodiments, the chassis and water lines are created by ultrasonically bonding two rigid plastic bodies together. This allows the bidet attachment to forgo the use of water hoses. By doing so, the stack height of the bidet can be greatly reduced. For example, an exemplary bidet chassis thickness is only 6.3 mm, which allows it to fit under most toilet seats without any need for additional clearance. This is in contrast to current bidet attachments that utilize water hoses/tubes and require much more clearance room. FIG. 1C illustrates a front view of an example bidet attachment, in accordance with embodiments of the present disclosure. The front view of bidet attachment 100 shows the thickness 122 of the chassis. In some embodiments, to further increase the cleanliness of the bidet attachment, all parting lines and seams to the plastic bodies have been minimized or moved to the bottom surface of the product.

Figure 1D:
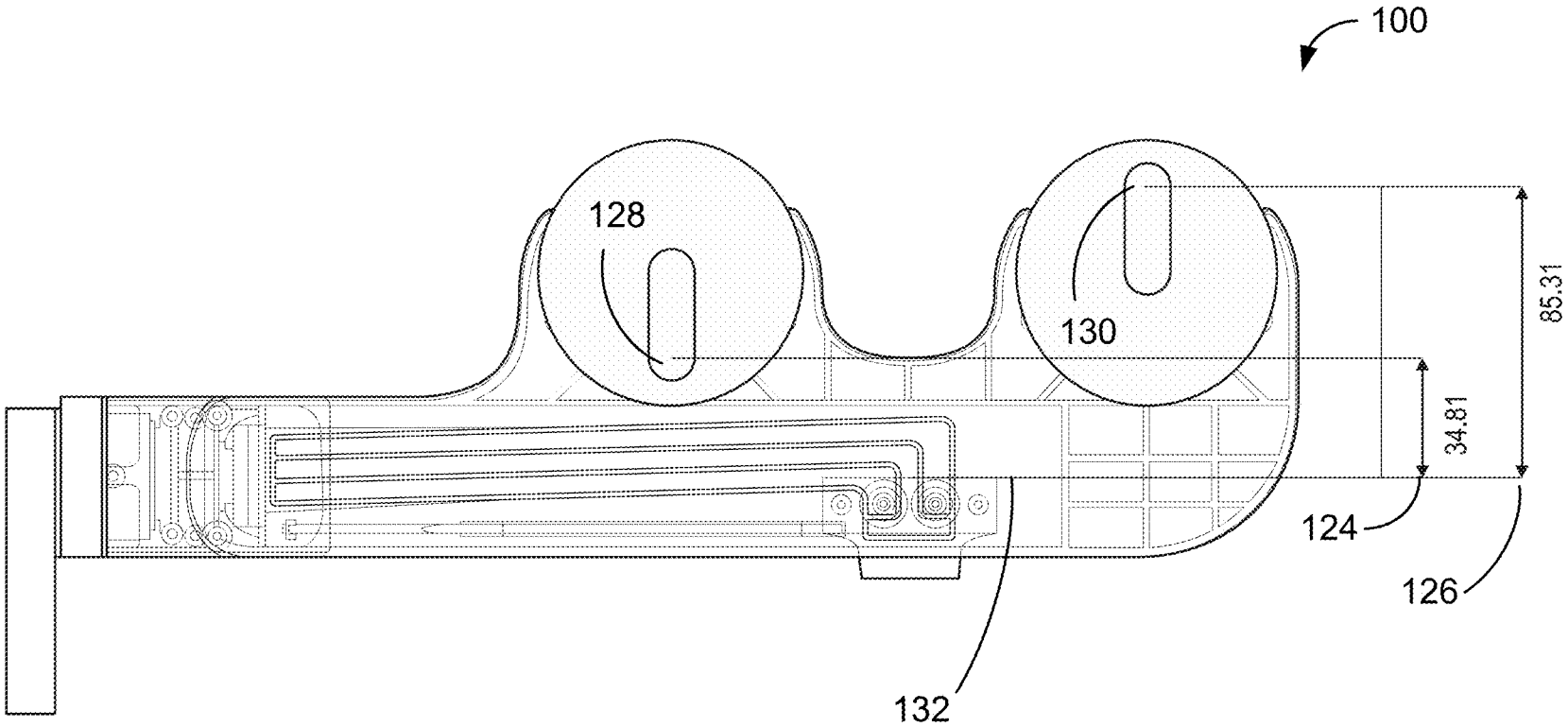
FIG. 1D illustrates a bottom view of an example bidet attachment, in accordance with embodiments of the present disclosure.

FIG. 1D illustrates a bottom view of an example bidet attachment showing the flexibility of the mounting disc design. FIG. 1D shows that the tightest distance 124 allowed from the closest slot position 128 to the back edge of the sprayer housing 132 is 34.81 mm. In addition, FIG. 1D also shows that the furthest distance 126 allowed from the farthest slot position 130 to the back edge of the sprayer housing 132 is 85.31 mm. Thus, even though the mounting discs have only half slots, the rotational design allows for maximum flexibility in mounting distance, in order to accommodate a variety of different toilet designs.

As briefly mentioned above, there are many problems with today's bidet attachments. However, the techniques and mechanisms of the present disclosure provide solutions to these problems. A more detailed description of the problems and solutions is provided below.

One problem for bidets is that over time, through repeated usage, grime gets stuck in the traditional mounting disc opening. A traditional mounting disc opening spans the full diameter of the mounting discs. The opening is where the toilet seat bolts pass through for installation. Once installed, gunk, grime, and hair get stuck in the excess space in the mounting disc openings.

Figure 2A:
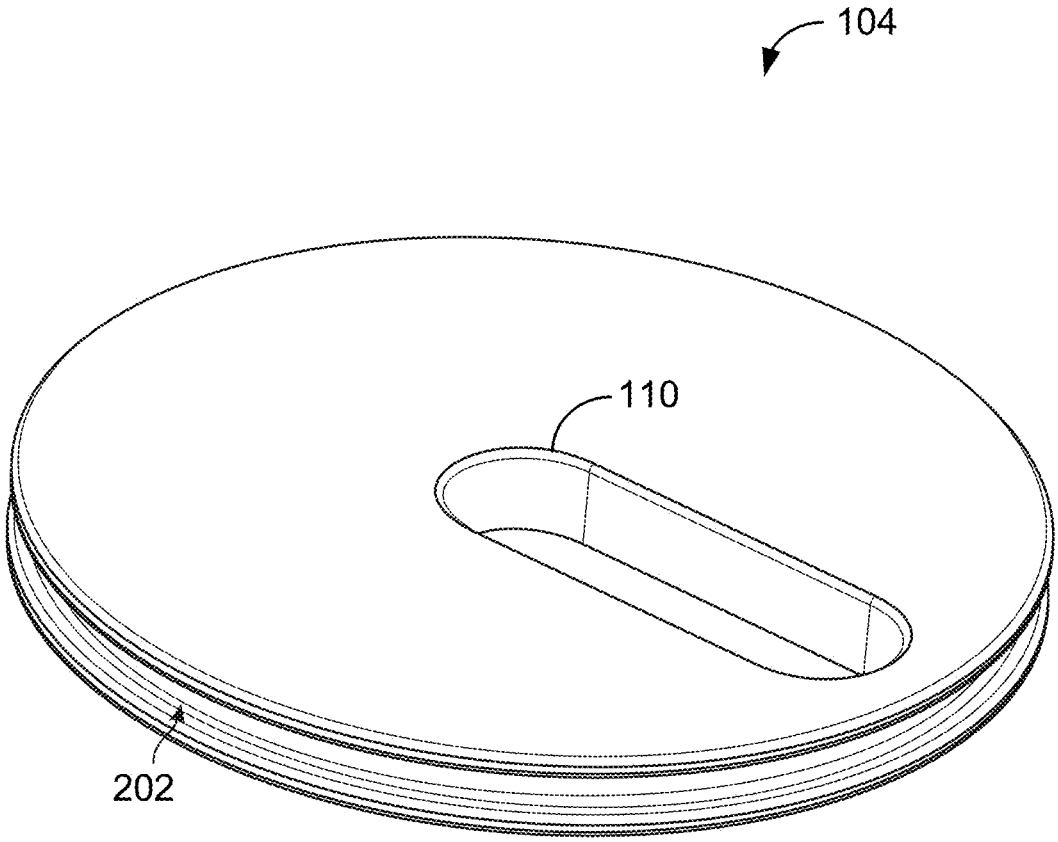
FIG. 2A illustrates an example mounting disc, in accordance with embodiments of the present disclosure.

According to various embodiments, the techniques and mechanisms of the present disclosure solve this problem by reducing the diameter of the opening in the mounting discs by 50%. FIG. 2A illustrates an example mounting disc, in accordance with embodiments of the present disclosure. As illustrated in FIG. 2A, the opening 110 is around 50% of the diameter of mounting disc 104. In some embodiments, the length of the opening is actually slightly more or less than 50% of the diameter of the mounting disc. This solution still accommodates all toilet installation needs because the disc is designed such that a user can spin the disc as needed to line up the toilet seat bolts that must pass through during installation. During installation, the mounting disc openings align with bolts on the toilet seat. However, after installation, the mounting discs can then be rotated such that the open spaces sit directly underneath the toilet seat mounting connections. If the open spaces are rotated to be directly underneath the toilet seat mounting connections, the bidet mounting disc openings are 100% hidden, which means that no gunk, grime, or hair can get stuck in this area.

Another problem for bidets is that once installed, proper cleaning of the toilet becomes very difficult because the bidet is securely fixed into place and obstructs easy access to certain areas of the toilet bowl. For example, the bidet chassis prevents the user from being able to wipe down the seat connection area and the bidet spray nozzle blocks a toilet brush from being able to clean the back of the toilet bowl. Oftentimes, users just choose not to clean these areas of the toilet because they would have to otherwise unscrew and remove the toilet seat, remove the bidet, clean the toilet, remount the bidet, add the toilet seat back on, and re-screw the toilet seat bolts. This is a very time consuming and laborious process.

Figure 2B:
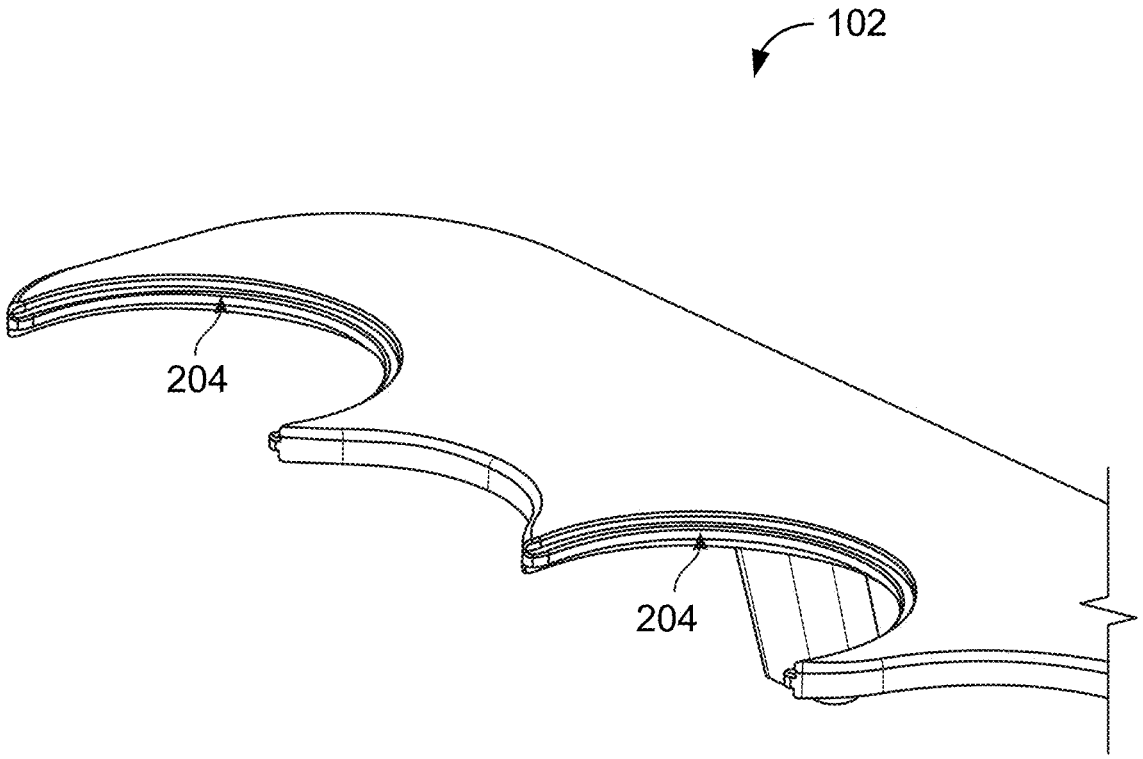
FIG. 2B illustrates an example snap fit chassis body, in accordance with embodiments of the present disclosure.

According to various embodiments, the techniques and mechanisms of the present disclosure provide for a novel snap fit design that allows a bidet attachment to be mounted and unmounted in a matter of seconds once installed. Referring back to FIG. 2A, in some embodiments, mounting disc 104 includes a center groove 202 that indexes with a center protruding lip 204 in the chassis disc insertion areas in chassis, as shown in FIG. 2B. Once mounting discs 104 are installed onto the toilet, bidet chassis 102 fits around the mounting discs precisely with the correct amount of tolerance by snapping into place. Having the ability to mount and dismount an installed bidet chassis allows a user to be able to properly clean the toilet by gaining full access to the toilet bowl without obstruction.

Figure 2C:
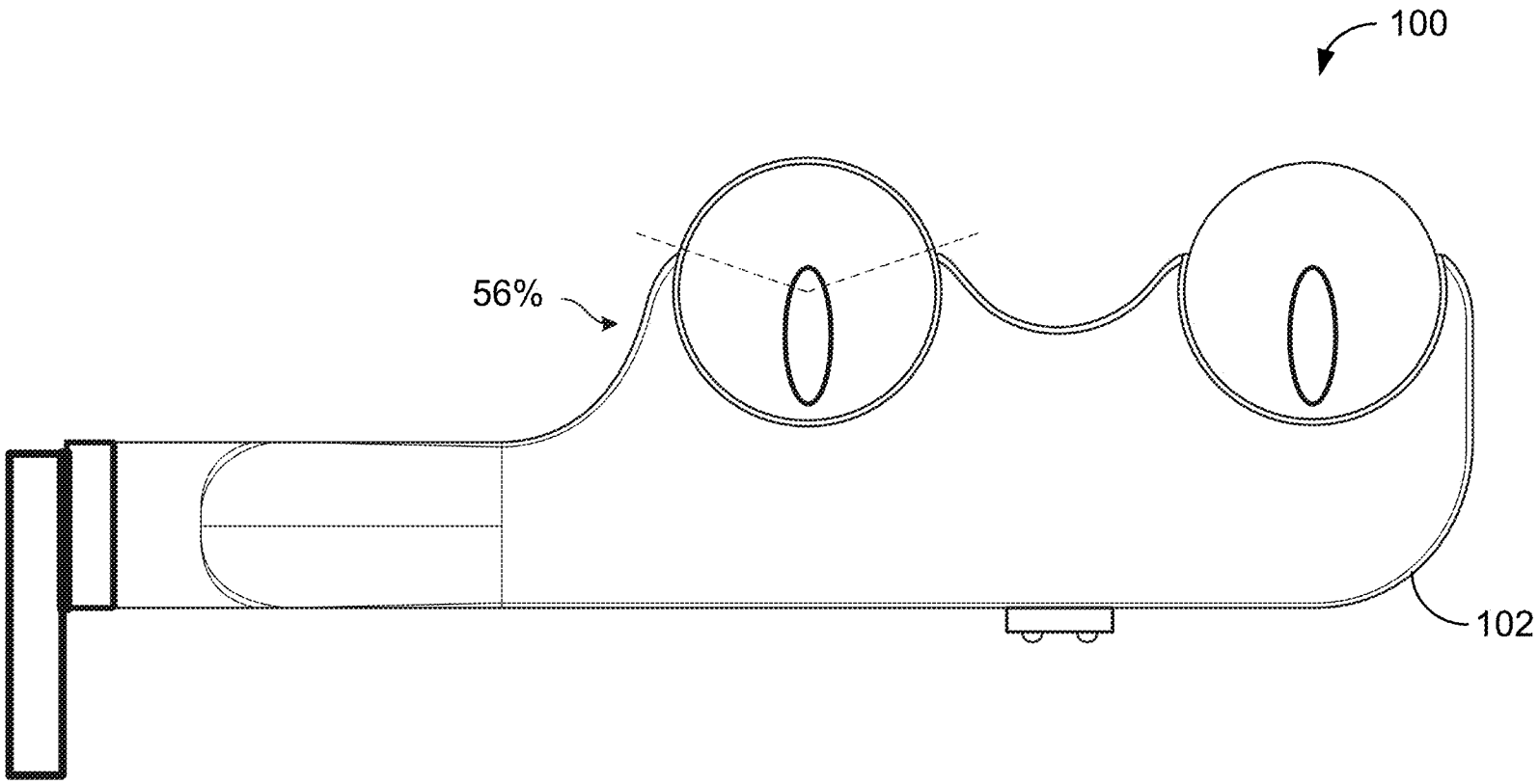
FIG. 2C illustrates an example snap fit chassis body with mounting discs attached, in accordance with embodiments of the present disclosure.

According to various embodiments, in order to properly implement a viable snap fit design, the details regarding the dimensions of the chassis insertion areas need to be tightly controlled. FIG. 2C illustrates an example snap fit chassis body with mounting discs showing just how much of the disc must be "wrapped around" in order to have an effective snap fit, in accordance with embodiments of the present disclosure. FIG. 2C shows that in an exemplary design, the chassis needs to wrap around 56% of the discs to securely hold the bidet attachment in place. If the chassis wraps around less than 56%, then the discs become unstable and the snap fit is no longer secure. However, while wrapping around the disc more than 56% would also secure the bidet, wrapping too much around the disc prevents easy insertion and removal of the discs. Thus, an exemplary chassis includes disc insertion areas that are configured to wrap around 56% of the circumference of the mounting disc in order to provide a stable experience, but also allowing users to quickly remove the bidet from the toilet for thorough cleaning of the toilet, and the bidet itself.

Figure 2D:
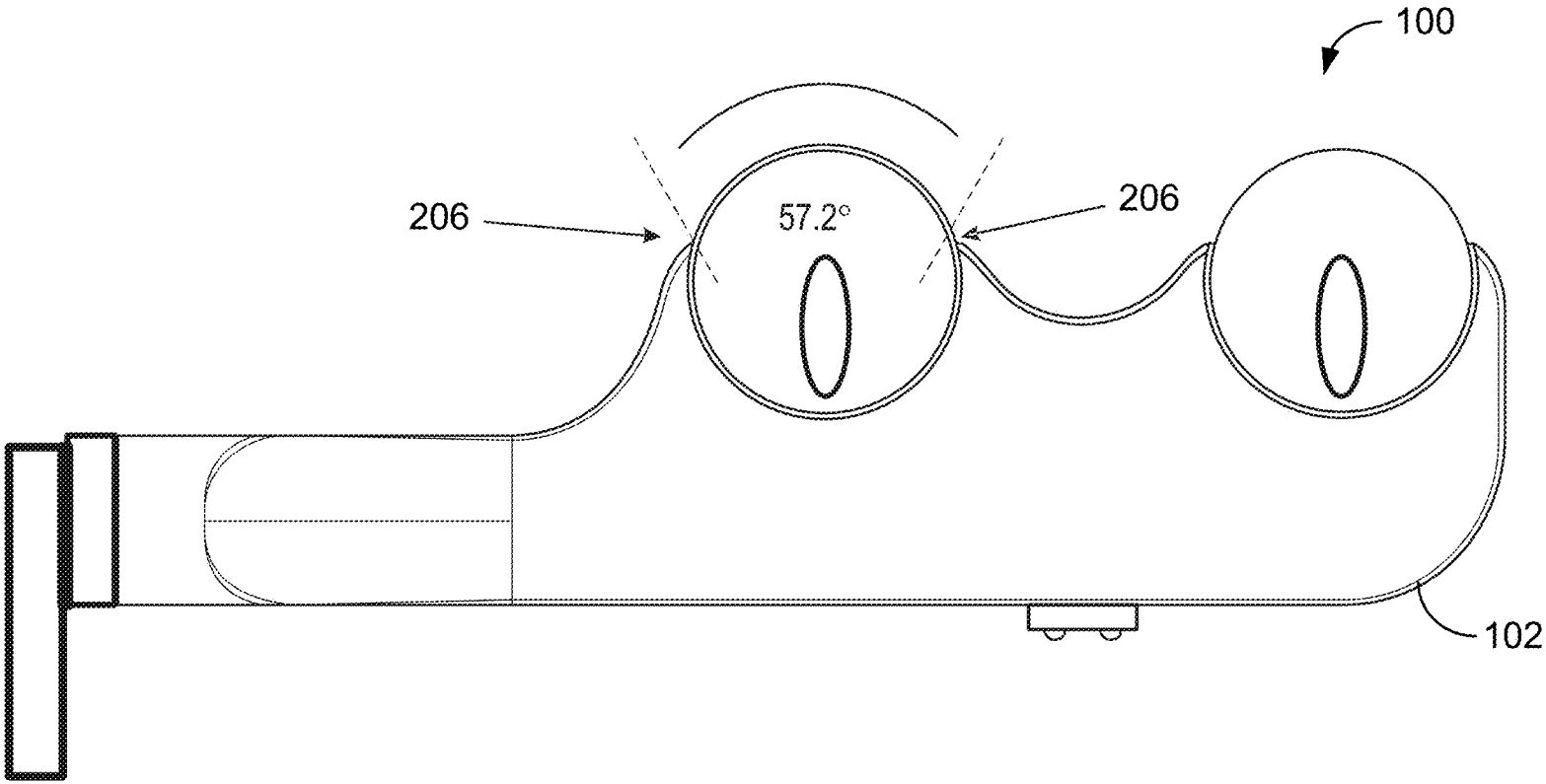
FIG. 2D also illustrates an example snap fit chassis body with mounting discs attached, in accordance with embodiments of the present disclosure.

In addition to wrapping around the mounting disc at a certain percentage of the disc circumference, the mounting chassis also have a unique feature to further ease insertion of the mounting discs. FIG. 2D shows the chassis having customized leading edges 206 at both ends of the opening of the insertion areas for the mounting discs. In some embodiments, the leading edges 206 of the snap feature have an angle of around 57.2 degrees to allow easy alignment and insertion of the chassis. If the angle between the leading edges 206 is significantly less than 57.2 degrees, then the mounting discs would have a hard time fitting into the mounting disc slot. If the angle between the leading edges is significantly greater than 57.2 degrees, then the mounting discs may not attach securely to the chassis. In some embodiments, the edges 206 also have a significant rounded corner to further ease the task of snap-fitting.

In some embodiments, the mounting discs need not be circular. In such embodiments, the mounting discs can have a square or any other polygonal shape that allows for a snap fit mounting mechanism. In some embodiments, the snap fit design is further enhanced using magnets. Such magnets would help snap the mounting discs into place and use magnetic force to increase the sturdiness. In some embodiments, the bidet attachment is designed such that the tolerance to the mounting discs is a 0.05 mm offset, which was empirically determined to be the optimal tolerance. In some embodiments, the mounting disc has a 73 mm diameter.

Figure 2E:
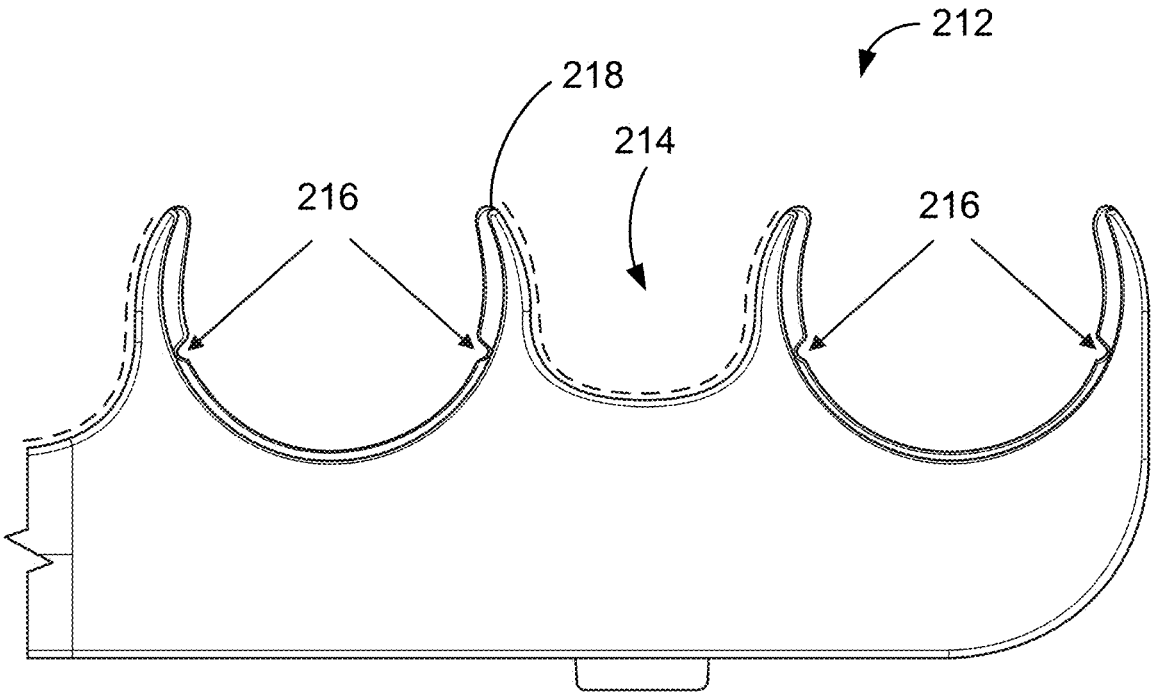
FIG. 2E illustrates another example snap fit chassis body, in accordance with embodiments of the present disclosure.

In some embodiments, the chassis can be modified further to facilitate the snap-fit mechanism. FIG. 2E illustrates an example of a modified snap fit chassis body, in accordance with embodiments of the present disclosure. Chassis 212 is similar to chassis 102 as described above, but with a few modifications. One modification includes a section cut out 214 of the disc retention rib. In chassis 102 previously described, this section had a much shallower cutout. The new modified cut out 214 allows for more flexibility during insertion and removal of the mounting discs. In addition, chassis 212 also includes and one or more flex notches 216 in the arms in order to improve flexibility of the chassis. In some embodiments, the profile of the arms 218 have also been revised to create a thinner, more flexible system. It is important to note that although these modifications all improve flexibility of the chassis, the modifications were carefully designed such that the fit of the mounting discs to the chassis when installed still remained secure.

Figure 2F:
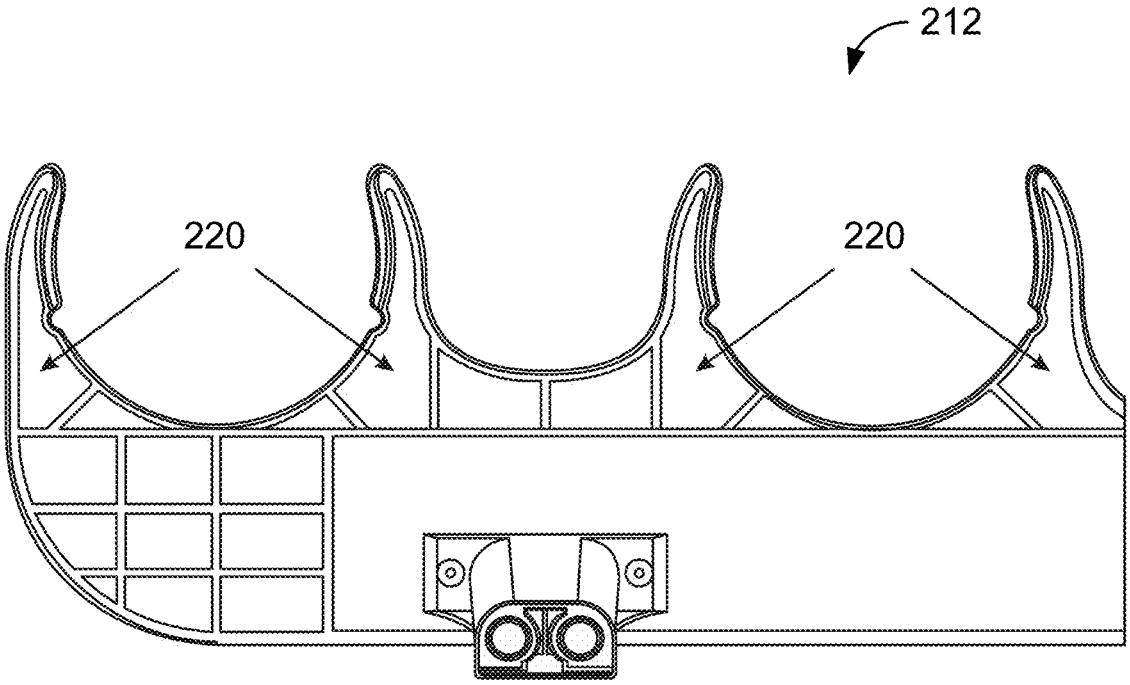
FIG. 2F illustrates a horizontal slice view of another example snap fit chassis body, in accordance with embodiments of the present disclosure.

FIG. 2F illustrates a bottom view of the modified chassis, in accordance with embodiments of the present disclosure. As shown in FIG. 2F, chassis 212 has a ribbing structure removed at the flex joint 220 to also improve mobility of the plastic. In some embodiments, a ribbing structure at the flex joint 220 contributed to stiffness of the chassis during installation onto the mounting discs. In some embodiments, removal of the ribbing structure alleviated the stiffness.

Figure 2G:
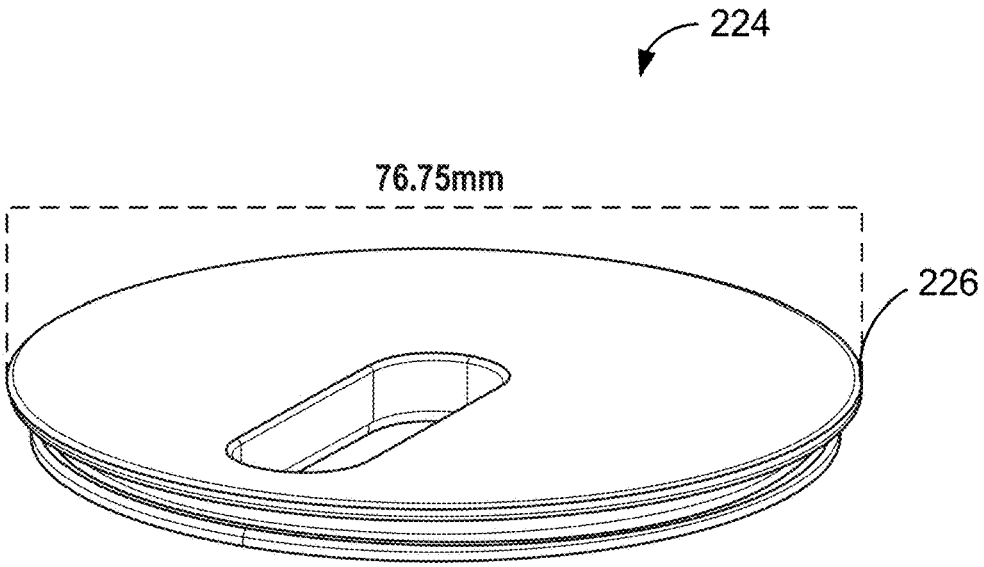
FIGS. 2G-2H illustrate another example mounting disc, in accordance with embodiments of the present disclosure.
Figure 2H:
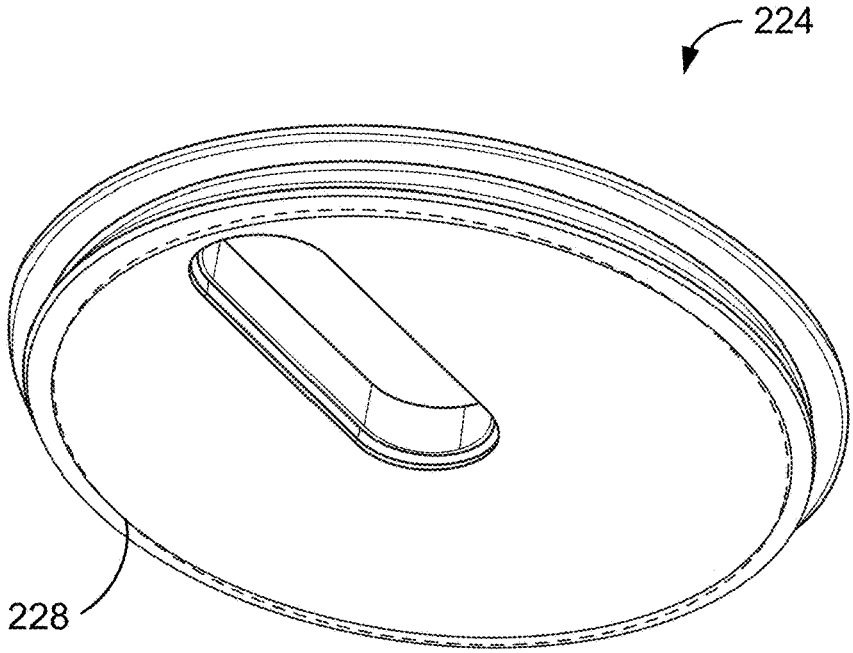

In some embodiments, the mounting discs themselves can be modified to prevent misalignment and improve fit. FIGS. 2G and 2F illustrate an example of a modified mounting disc, in accordance with embodiments of the present disclosure. As shown in FIGS. 2G and 2F, modified mounting disc 224 is wider at the top (with a diameter of 76.75 mm) than the bottom. The diameter of top lip 226 of mounting disc 224 is increased relative to the diameter of bottom lip 228, in order to hide the gap created when material was removed on the chassis for flexibility (see FIGS. 2E and 2F). This increase in the top lip diameter helped tighten up the fit of the system as well as created a poka-yoke disc that cannot be installed incorrectly. In embodiments where the top lip was not wider than the bottom lip, mounting discs could be accidentally installed upside down. The asymmetric design of the modified mounting disc makes this impossible to do. In some embodiments, a pliable grip pad has been added to bottom side of mounting disc 224, in order to help the chassis and discs adhere to the porcelain bowl of the toilet.

The above paragraphs mentioned problems with cleanliness with current bidets. Yet another problem with bidets is that sometimes water can be accidentally activated. For example, a child or a pet can accidentally turn on or bump into the water activating knob/handle, and then walk away leaving water spraying out of the toilet and onto the floor. In addition to causing a potential flooding problem, if this goes unnoticed for several hours, there could be lots of water damage done to the property.

Figure 3A:
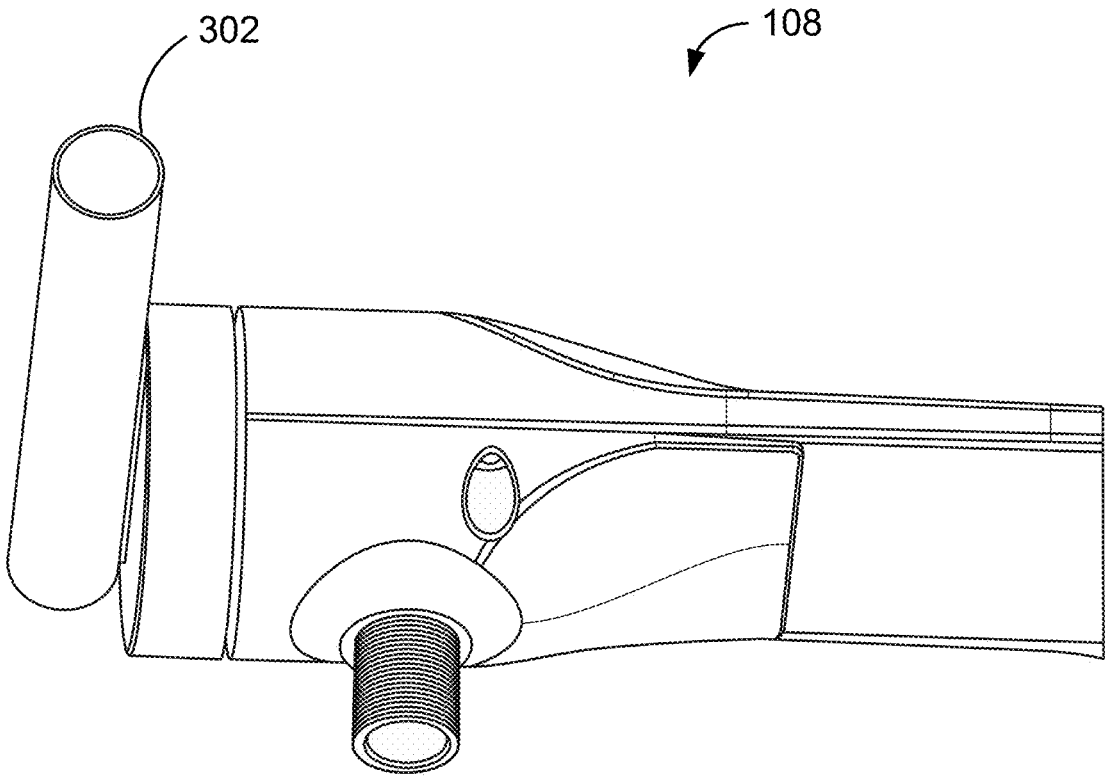
FIG. 3A shows an example lever handle, in accordance with embodiments of the present disclosure.
Figure 3B:
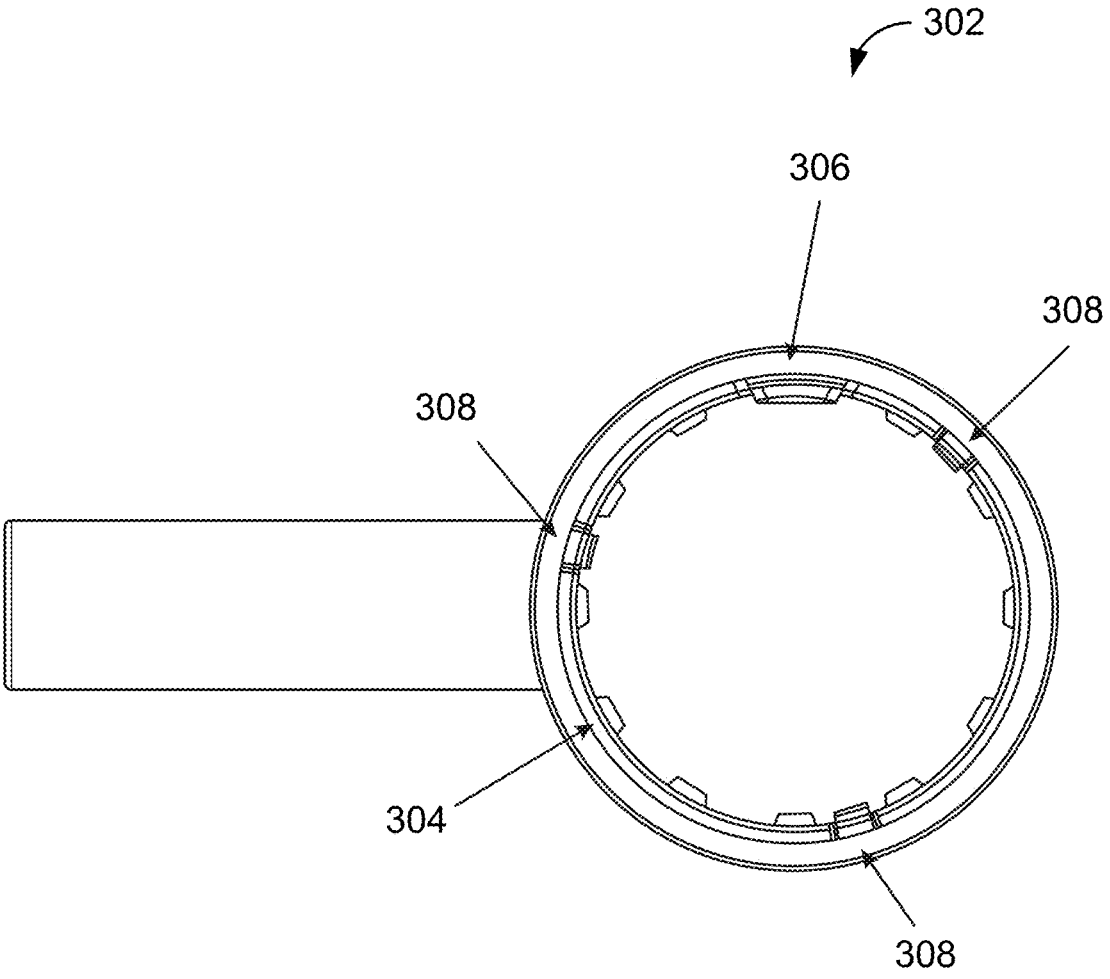
FIG. 3B shows details of an example handle, in accordance with embodiments of the present disclosure.
Figure 3C:
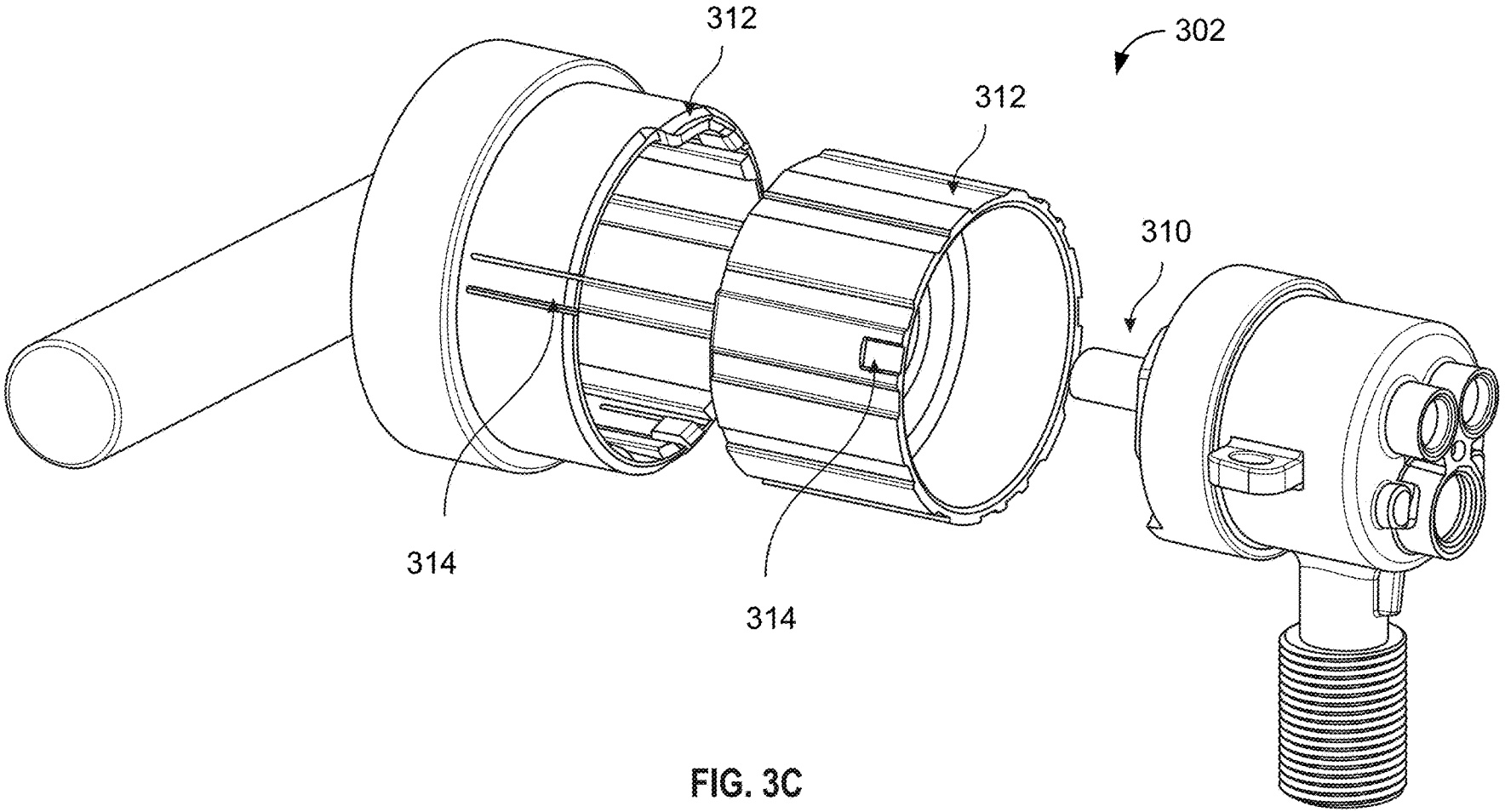
FIG. 3C shows an exploded view of an example lever handle, in accordance with embodiments of the present disclosure.

According to various embodiments, the techniques and mechanisms of the present disclosure provide for a bidet attachment water activation handle design that is activated by rotating between up and down positions, with the lever handle being configured to automatically return to the off position when the user is not applying pressure. FIG. 3A shows an example lever handle, in accordance with embodiments of the present disclosure. In some embodiments, lever handle 108 includes a snug fit design 310, with unidirectional insertion (poka-yoke insertion) 312 and torsion snap features 314, as shown in FIG. 3C. In some embodiments, the torsion snap includes 3 distinct snaps. In some embodiments, the handle 302 is designed to be interchangeable with different designs/colors/materials and potential custom designs. In such embodiments, handle 302 can be easily removed by the user without the use of tools, and a new or different designed handle can be swapped in. One exemplary implementation of this feature, as shown in FIG. 3B, is a handle with 12 splined ribs 304 that mate with 12 corresponding grooves on an adjacent valve adapter mechanism. In some embodiments, handle 302 also includes a single longer and larger rib 306 to serve as a visual aid for orienting to the valve adapter. This longer rib serves as a pokey yoke, or safeguard, feature. In some embodiments, handle 302 also includes 3 flexible arms 308 with embossing to create the snap feature. The features described above combine to make a quick release handle that allows the user to quickly swap out different handles in order to customize their bidet.

Figure 3D:
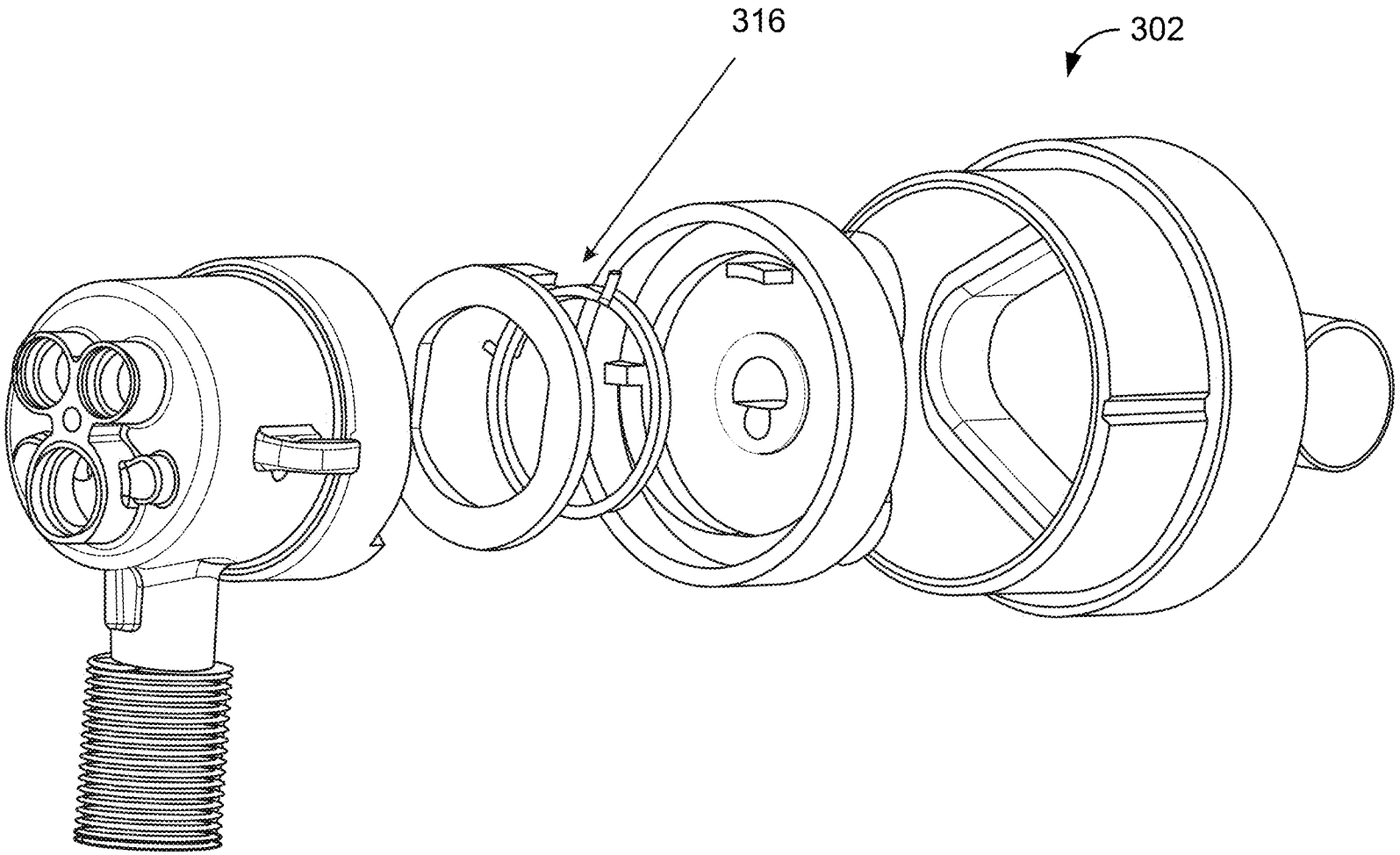
FIG. 3D shows another exploded view of an example lever handle, in accordance with embodiments of the present disclosure.
Figure 3E:
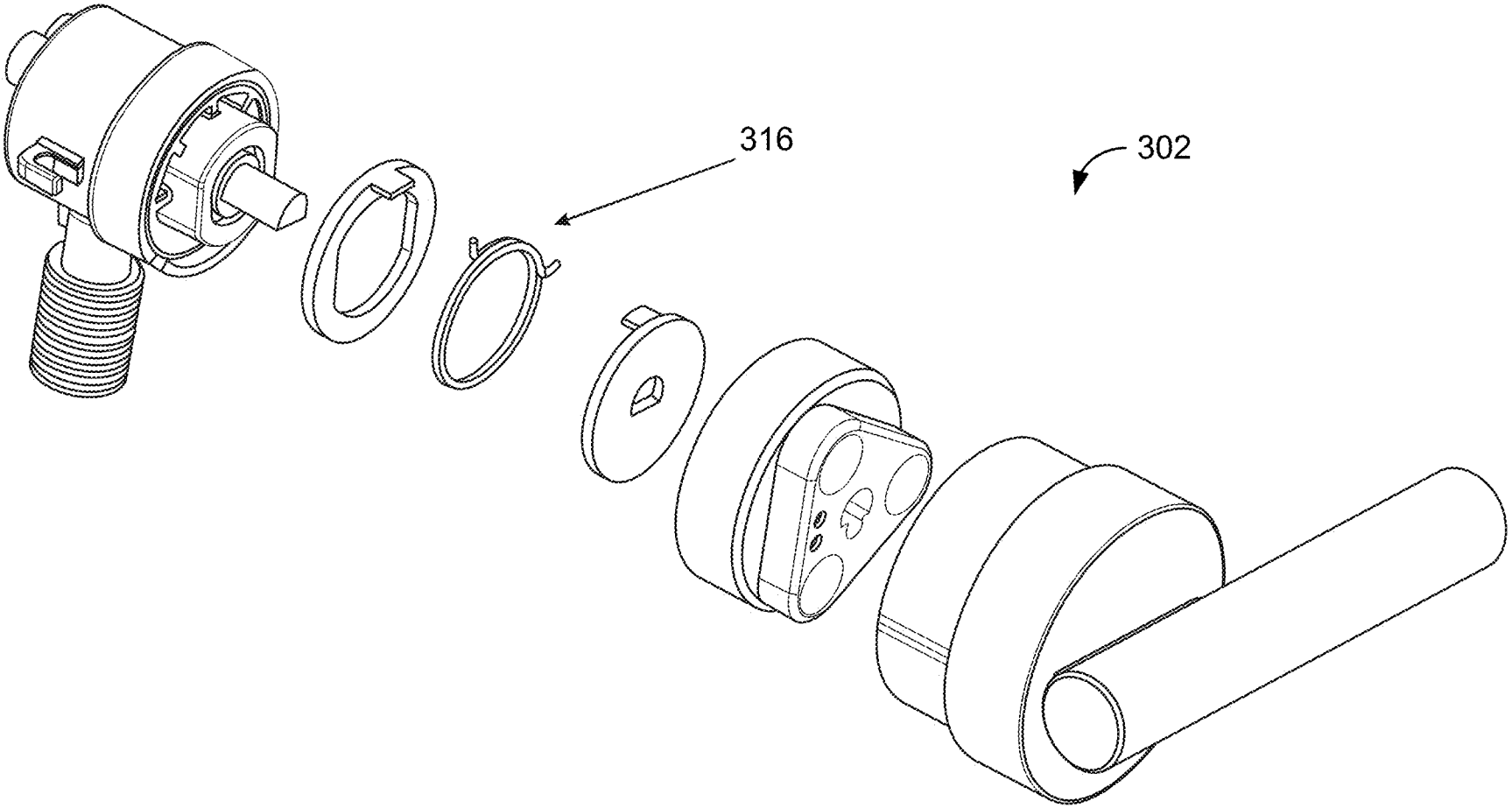
FIG. 3E shows yet another exploded view of an example lever handle, in accordance with embodiments of the present disclosure.

According to various embodiments, the lever handle comprises a specialized and very small transmission capable of switching between two perfectly calibrated flat torsion springs. These torsion springs provide enough force to return the handle to the off position when the handle is turned in either direction. In some embodiments, the springs can be coil springs or tape springs, or any other type of spring, so long as they are designed to shut off the water activation after some time. FIGS. 3D and 3E show two exploded views of an example lever handle, thereby showing details of the auto-shutoff feature. As shown in FIGS. 3D and 3E, a two-way spring 316 has two arms that engage with the handle in each direction, pulling the handle back to the neutral "off" position, thereby resulting in closing of the valve. Spring 316 ensures the lever handle returns to the off position after each use, preventing accidental triggering and potential flooding. In some embodiments, proximity sensors may be used to activate and keep the water active. In such embodiments, if the sensor does not sense anyone on the toilet, then the water will not turn on. In some embodiments, a timer can also be used to shut off the water after a predetermined amount of time.

Figure 3H:
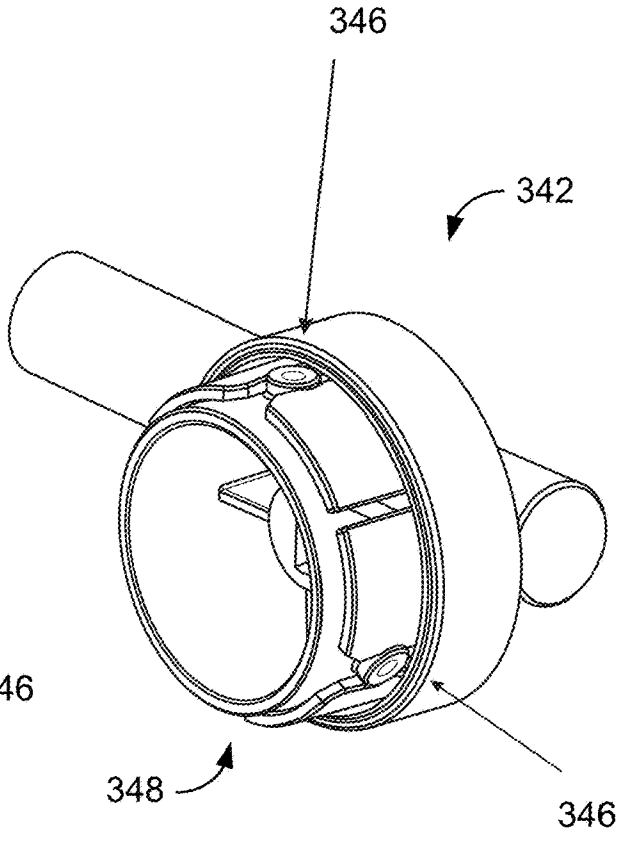
FIGS. 3F-3H show alternative design features of an example lever handle, in accordance with embodiments of the present disclosure.
Figure 3G:
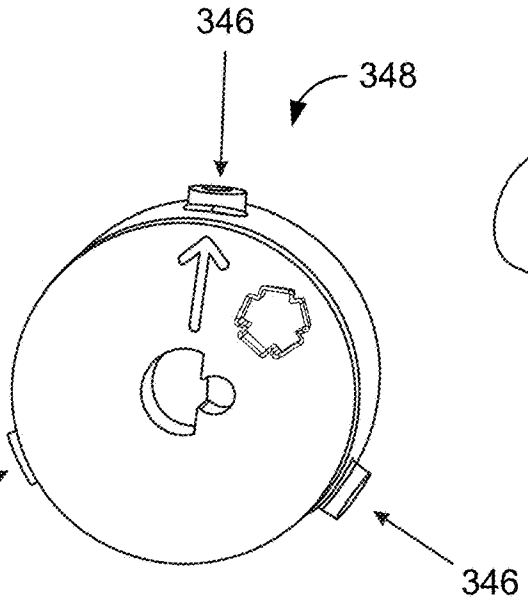
Figure 3F:
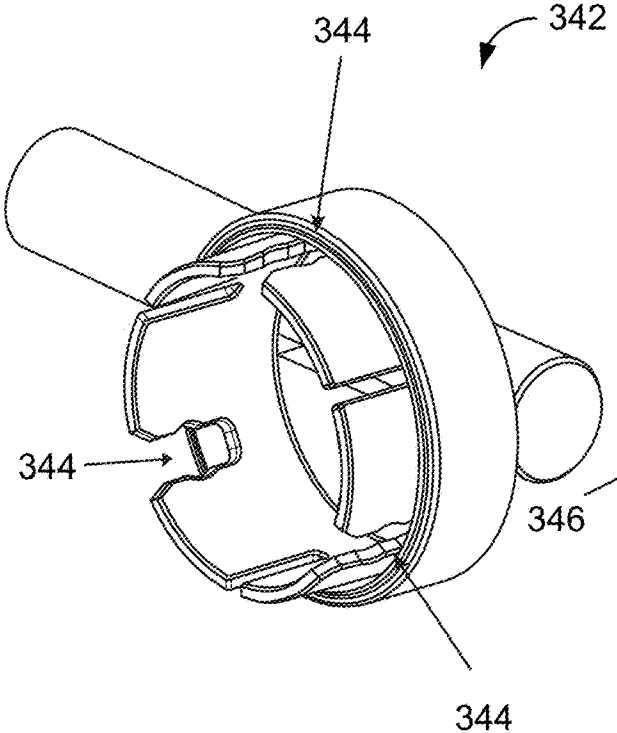

As with the mounting disc and chassis, in some embodiments, the lever handle can be modified to improve performance and facilitate ease in changing the handle. FIGS. 3F-3H illustrate modifications to the lever handle, in accordance with embodiments of the present disclosure. FIG. 3F shows lever handle 342 equipped with 3 new slots 344. These 3 slots 344 are designed to guide 3 new round bosses 346 on cylinder walls of valve adapter 348, as shown in FIG. 3G. FIG. 3H shows lever handle 342 assembled together with valve adapter 348. This increased performance of the handle and left to right engagement with the valve system results in a much tighter fit and better handle swap performance.

The above paragraphs described cleanliness and water shut off problems for current bidets. Yet another problem for bidets is that due to the spray nozzle hanging at a 90 degree angle, some toilets with rounded or sloped shaped bowls provide for an awkward fit between the bidet and the toilet seat. Some bidet attachments are an add-on product for mounting to any toilet found in a home, but toilets come in many different form factors. Many toilets have a rounded or sloped toilet bowl edge (the first few inches of the top of the inner toilet bowl). This roundedness or slope interferes with the bidet sprayer nozzle which hangs a few inches into the bowl at a 90 degree angle. Because the nozzle sprayer sits at a 90 degree angle, it can only be installed as close as the farthest point of the rounded or sloped toilet bowl edge causing the bidet attachment to stick out further over the bowl than necessary, typically by 0.5-1 inches. This additional overhang then interferes with the toilet seat when the toilet seat is down. This could lead to a few problems, such as: (a) the toilet seat catches the additional overhang causing the toilet seat to not lay flat and thereby making the bidet incompatible with the toilet or maybe even breaking the toilet seat, or (b) the toilet seat may lay flat, but the extra overhang of the bidet is now sticking out further than the toilet seat itself, which is visually unappealing and literally is in the way while a user is using the toilet to go to the bathroom.

Figure 4:
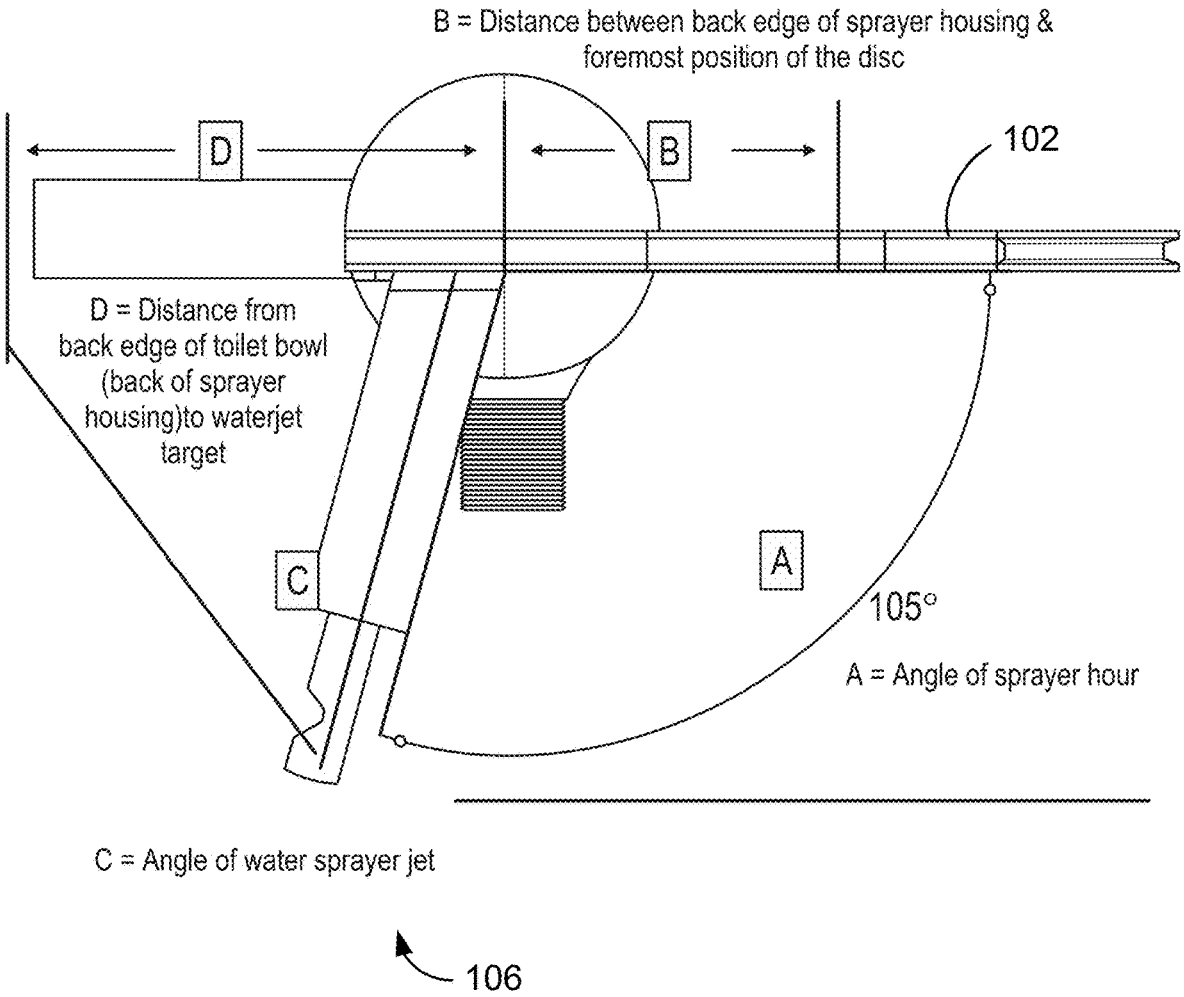
FIG. 4 illustrates an example sprayer nozzle, in accordance with embodiments of the present disclosure.

FIG. 4 illustrates an example sprayer nozzle, in accordance with embodiments of the present disclosure. According to various embodiments, the techniques and mechanisms of the present disclosure provide for bidet attachments with a sprayer nozzle 106 that connects to bidet chassis 102 at an angle of around 105 degrees. By sloping sprayer nozzle 106, this would allow the bidet attachment to fit all sloped toilets and rounded edged toilets. According to various embodiments, A is the angle of the sprayer, B is the distance between the back edge of sprayer housing and foremost position of the disc, C is the angle the water sprayer jet, and D is the distance from the back edge of the toilet bowl to the waterjet target. This would consequently lead to a fit that is significantly closer (at least 0.5 inches closer) to the toilet itself (as compared to current bidet attachments), thereby eliminating the interference problems. For the majority of toilets, the 105 degree angle allows the user to push the bidet to the back edge of the toilet bowl during mounting and minimize the size of the discs needed to accommodate the majority of seat mounting holes, thus further reducing the bidet's overall package size. Embodiments with an angle significantly greater than 105 degrees tended to interfere with usage of the toilet. Embodiments with an angle significantly less than 105 degrees tended to interfere with the back of the toilet bowl.

Figure 5A:
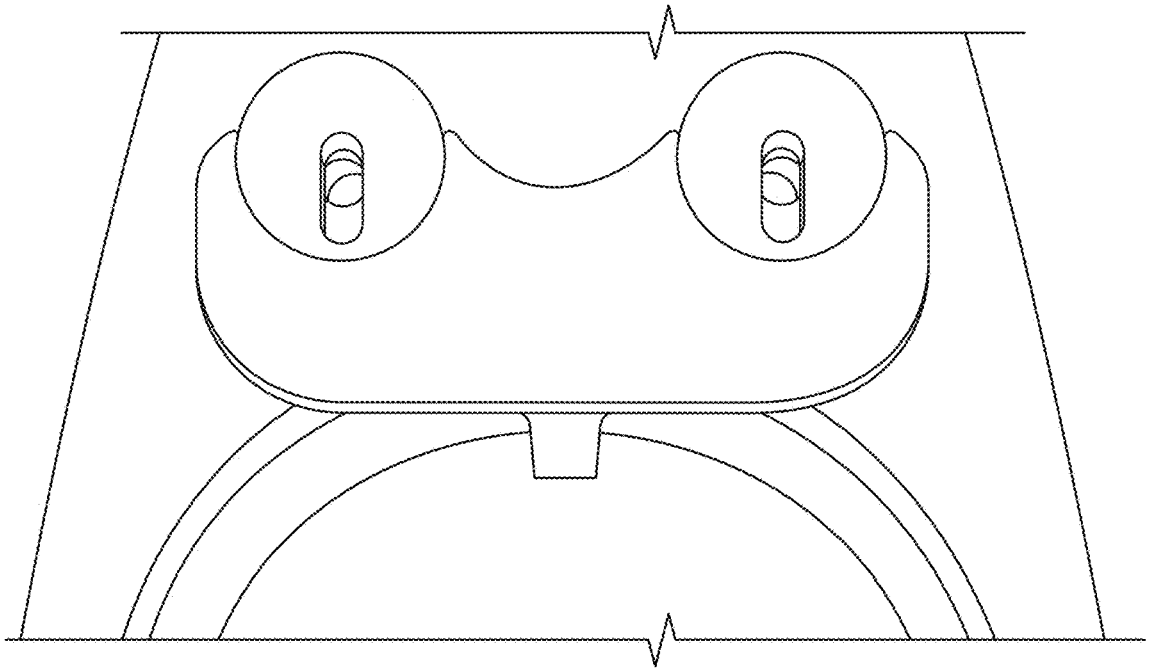
FIGS. 5A-5B illustrate an example of mounting discs and snap fit chassis attached to a toilet without the toilet seat attached, in accordance with embodiments of the present disclosure.
Figure 5B:
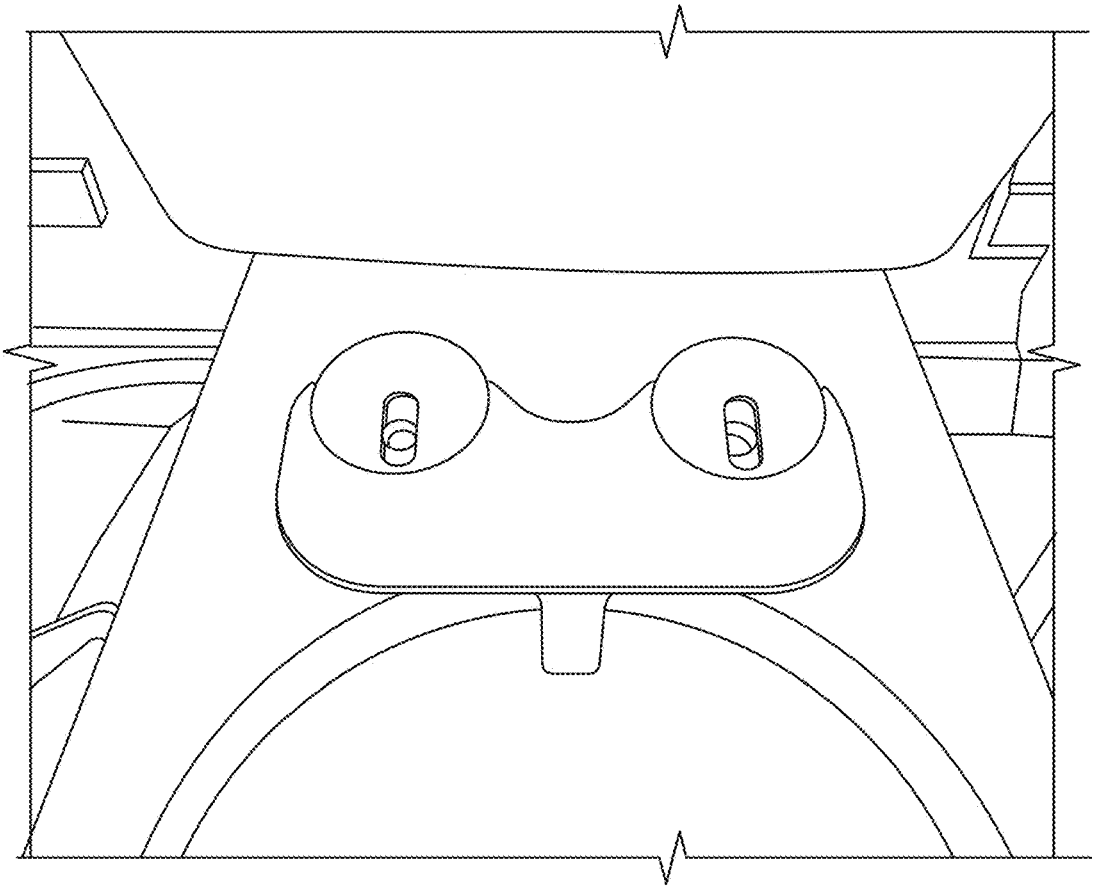
Figure 5C:
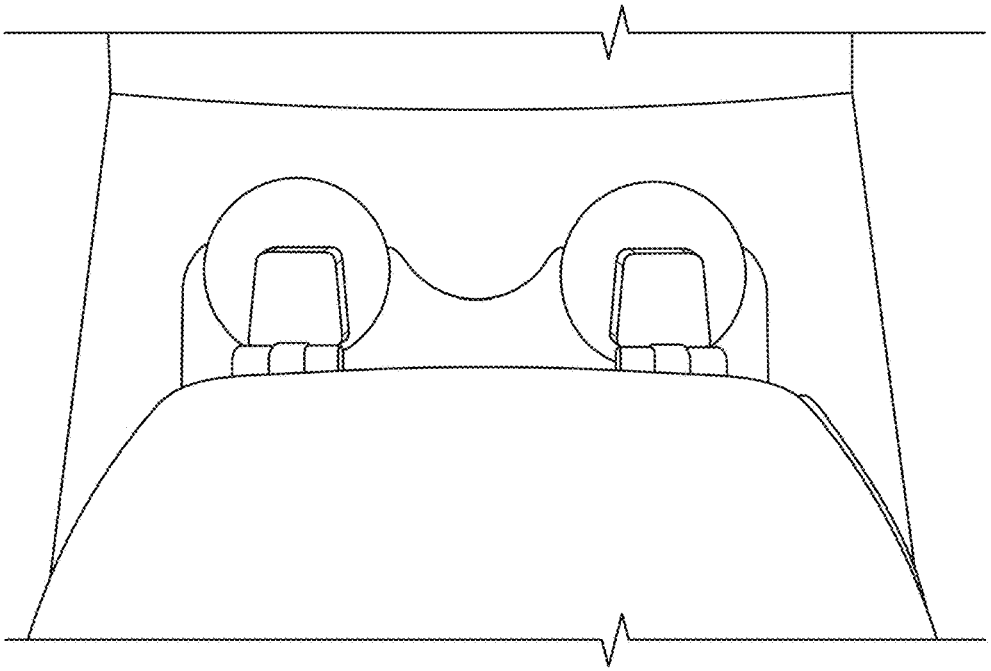
FIGS. 5C-5D illustrate an example of mounting discs and snap fit chassis attached to a toilet with the toilet seat attached, in accordance with embodiments of the present disclosure.
Figure 5D:
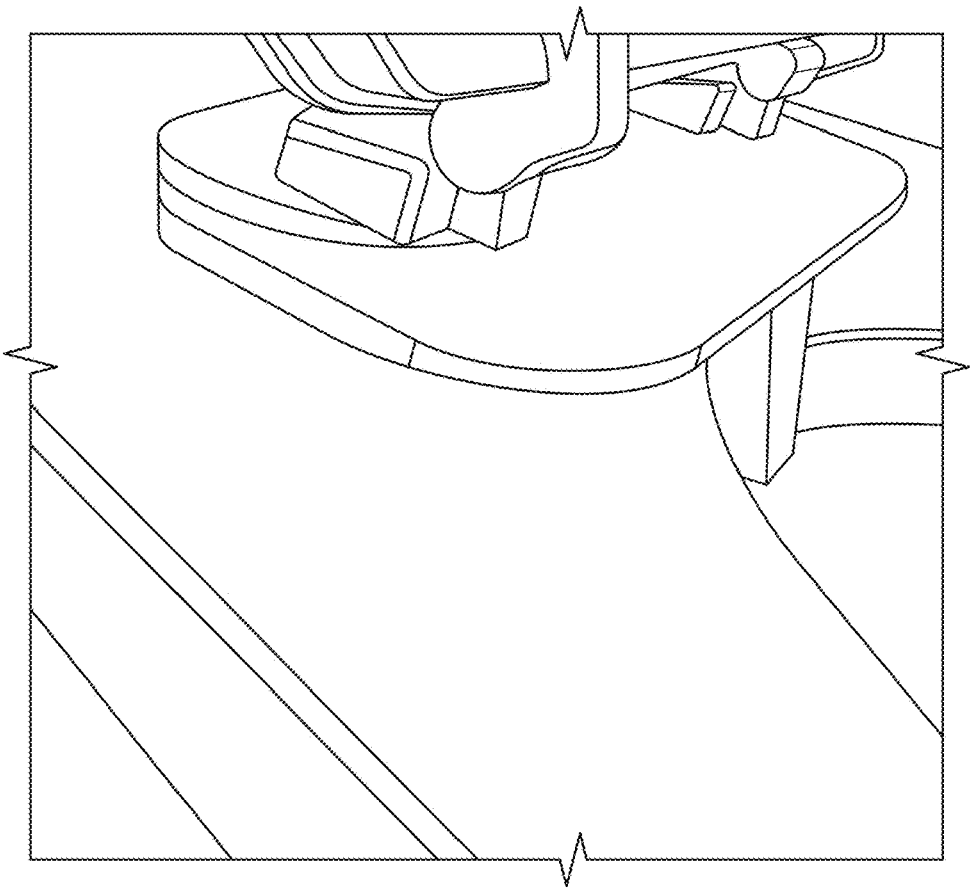

FIGS. 5A and 5B illustrate an example of mounting discs and snap fit chassis attached to a toilet without the toilet seat attached, in accordance with embodiments of the present disclosure. FIGS. 5C-5D illustrate an example of mounting discs and snap fit chassis attached to a toilet with the toilet seat attached, in accordance with embodiments of the present disclosure.

In the foregoing specification, the present disclosure has been described with reference to specific embodiments. However, one of ordinary skill in the art appreciates that various modifications and changes can be made without departing from the scope of the present disclosure as set forth in the claims below. Accordingly, the specification and figures are to be regarded in an illustrative rather than a restrictive sense, and all such modifications are intended to be included within the scope of present disclosure.

What is claimed is:

1. A bidet attachment comprising:

a chassis configured to mount to two mounting discs via a snap fit mechanism;

a sprayer nozzle; and a water valve lever configured to activate and shut off water spraying through the sprayer nozzle.

2. The bidet attachment of claim 1, wherein each of the mounting discs are configured to rotate after being mounted to the chassis.

3. The bidet attachment of claim 1, wherein each of the mounting discs comprises a single opening in an otherwise solid disc, the opening having a length of just under half of a diameter of the mounting disc, and a width that is less than half of the length.

4. The bidet attachment of claim 1, wherein the sprayer nozzle is attached to the chassis at an angle that is greater than 90 degrees and less than 105 degrees.

5. The bidet attachment of claim 1, wherein the water valve lever is configured to automatically shut off after it has been turned on for some time.

6. The bidet attachment of claim 5, wherein the water valve lever includes two torsion springs to cause it to shut off automatically.

7. The bidet attachment of claim 1, wherein the water valve lever comprises a handle that is interchangeable with other handles by using magnets and/or a snap fit feature.

8. A toilet comprising:

a toilet bowl;

a toilet seat coupled to the toilet bowl via one or more toilet seat bolts; and a bidet attachment coupled to the toilet bowl via the one or more toilet seat bolts, wherein the bidet attachment sits in between the toilet bowl and the toilet seat, the bidet attachment comprising:

a chassis configured to mount to two mounting discs via a snap fit mechanism;

a sprayer nozzle; and a water valve lever configured to activate and shut off water spraying through the sprayer nozzle.

9. The toilet of claim 8, wherein each of the mounting discs are configured to rotate after being mounted to the chassis.

10. The toilet of claim 8, wherein each of the mounting discs comprises a single opening in an otherwise solid disc, the opening having a length of just under half of a diameter of the mounting disc, and a width that is less than half of the length.

11. The toilet of claim 8, wherein the sprayer nozzle is attached to the chassis at an angle that is greater than 90 degrees and less than 105 degrees.

12. The toilet of claim 8, wherein the water valve lever is configured to automatically shut off after it has been turned on for some time.

13. The toilet of claim 8, wherein the water valve lever includes two torsion springs to cause it to shut off automatically.

14. The toilet of claim 8, wherein the water valve lever comprises a handle that is interchangeable with other handles by using magnets and/or a snap fit feature.

15. A bidet, comprising:

a chassis comprising one or more openings configured to slidably connect to one or more mounting discs, wherein the mounting discs are mounted to a toilet at toilet seat attachment points, wherein the chassis is removable upon disconnection from the one or more mounting discs;

a nozzle connected to the chassis; and a water flow controller connected to the chassis, the water flow controller configured to adjust water flow through the nozzle.

16. The bidet of claim 15, wherein the one or more mounting discs are configured to rotate after being mounted to the chassis.

17. The bidet of claim 15, wherein the one or more mounting discs comprise a single opening in an otherwise solid disc, the opening having a length of just under half of a diameter of the mounting disc, and a width that is less than half of the length.

18. The bidet of claim 15, wherein the nozzle is attached to the chassis at an angle that is greater than 90 degrees and less than 105 degrees.

19. The bidet of claim 15, wherein the water flow controller is configured to automatically shut off after it has been turned on for a predetermined period of time.

20. The bidet of claim 19, wherein the water flow controller includes a torsion spring to cause automatic shut off.

* * * * *